United States Patent [19]

Baxter

[11] 4,398,636

[45] Aug. 16, 1983

[54] ARTICLE CASE AND BLANK THEREFOR

[75] Inventor: Ronald A. Baxter, Atlanta, Ga.

[73] Assignee: The Mead Corporation, Dayton, Ohio

[21] Appl. No.: 321,218

[22] Filed: Nov. 13, 1981

[51] Int. Cl.[3] ..... B65D 5/54

[52] U.S. Cl. ..... 206/614; 206/620; 206/615; 229/40

[58] Field of Search ..... 206/427, 612, 601, 614, 206/602, 615, 604, 605, 609, 610, 611, 621, 622, 206/623, 624, 625, 626, 627, 628, 634; 229/15, 27, 40

[56] References Cited

U.S. PATENT DOCUMENTS

| | | | |
|---|---|---|---|
| 970,220 | 9/1910 | Handschy | 229/27 |
| 1,328,524 | 1/1920 | Knapp | 229/15 |
| 3,114,474 | 12/1963 | Davis | 206/602 |
| 3,146,436 | 9/1964 | Hodapp | 206/624 |
| 3,147,856 | 9/1964 | Lightner et al. | 206/628 |
| 3,286,830 | 11/1966 | Robb, Jr. | 206/626 |
| 3,680,767 | 8/1972 | De Lorenzo et al. | 206/621 |
| 3,731,870 | 5/1973 | Buttery | 206/624 |
| 3,734,390 | 5/1973 | Buttery et al. | 206/609 |
| 3,780,931 | 12/1973 | Hanson | 229/27 |
| 3,833,165 | 9/1974 | Hoiles | 206/609 |
| 3,981,434 | 9/1976 | Ramich | 206/624 |
| 4,062,486 | 12/1977 | Goodrich | 206/626 |
| 4,216,861 | 8/1980 | Ociff | 206/611 |
| 4,228,945 | 10/1980 | Wysocki | 229/27 |

*Primary Examiner*—Joseph Man-Fu Moy
*Assistant Examiner*—David Fidei
*Attorney, Agent, or Firm*—Rodgers & Rodgers

[57] ABSTRACT

An article case comprising interconnected top, bottom and side walls, end panels joined to the end edges of the top and bottom walls and being secured in overlapping relation at each end of the case, a pair of spaced rib panels extending between the top and bottom walls, a connecting panel interconnecting the rib panels and being disposed in flat face contacting relation with the top wall, a tear strip formed in the connecting panel, and a removable portion being formed in the top wall and side panels, the tear strip being adapted for simultaneous removal with the removable portion from the tear strip.

12 Claims, 9 Drawing Figures

ARTICLE CASE AND BLANK THEREFOR

TECHNICAL FIELD

This invention relates to article cases which are constructed in an economical and sturdy fashion so as to prevent undesirable movement of the packaged articles such as tapered containers, and at the same time to allow for convenient access thereto.

BACKGROUND ART

Article cases such as contemplated by this invention are generally known in the art such as evidenced by the devices disclosed in U.S. Pat. Nos. 3,110,434 and 2,722,365.

DISCLOSURE OF THE INVENTION

By this invention an article case formed from a unitary blank is provided and comprises spaced top and bottom walls, side walls interconnecting the top and bottom walls, end panels joined to the end edges of the top and bottom walls, a pair of spaced rib panels extending between the top and bottom walls, a connecting panel joined to the upper edges of the rib panels and being disposed in flat face contacting relation with the lower surface of the top wall, a tear strip formed in the connecting panel, and a removable portion being formed in the top panel, the tear strip being adapted for simultaneous removal with the removable portion.

BEST MODE FOR CARRYING OUT THE INVENTION

Figure 1:
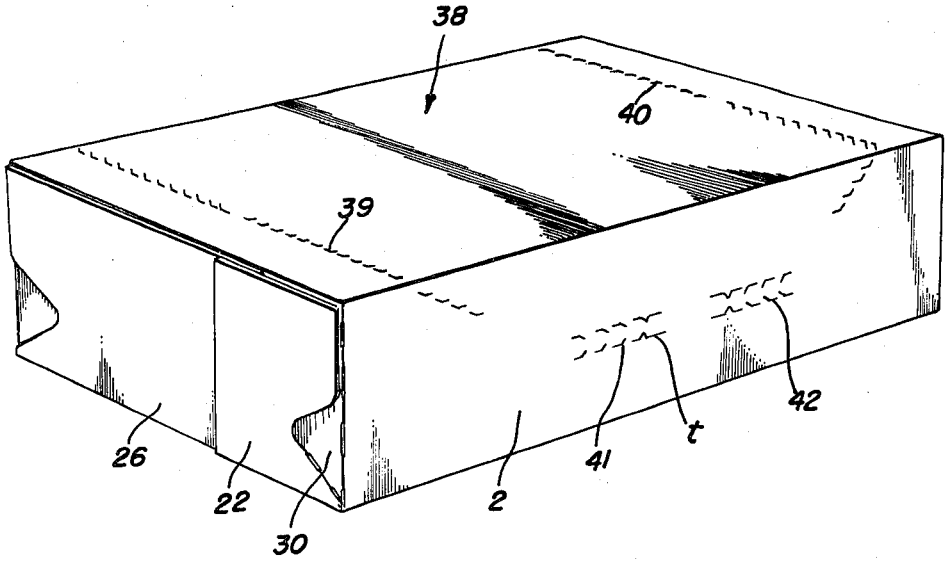
FIG. 1 is a perspective view of an article case formed according to this invention.

In the drawings the numeral 1 designates the top wall of the carrier to the side edges of which side walls 2 and 3 are foldably joined respectively along fold lines 4 and 5. In addition overlapping bottom panel 6 is joined to side wall 2 along fold line 7 and, in similar manner, overlapping bottom panel 8 is joined to side wall 3 along fold line 9. To complete the basic elements of the blank, rib panel 10 is joined to overlapping bottom panel 8 along fold line 11. To the opposite side edge of rib panel 10, connecting panel 12 is joined thereto along fold line 13. Also rib panel 14 is joined to connecting panel 12 along fold line 15. Finally glue flap 16 is joined to rib panel 14 along fold line 17.

End closure means for the article case is provided in the form of a series of end panels and end flaps. More specifically end panels 18 and 19 are joined respectively to the end edges of top wall 1 along fold lines 20 and 21. Also end panels 22 and 23 are joined respectively to the end edges of overlapping bottom panel 6 along fold lines 24 and 25. In like manner end panels 26 and 27 are joined respectively to the end edges of overlapping bottom panel 8 along fold lines 28 and 29.

Additional end closure means is provided in the form of end flaps 30 and 31 which are joined respectively to the end edges of side wall 2 along fold lines 32 and 33. Also end flaps 34 and 35 are joined respectively to the end edges of side wall 3 along fold lines 36 and 37. In addition the ends of each end flap 30, 31, 34 and 35 are joined along fold line a to web panel b and, in turn, web panel b is foldably joined along fold line c to the end of the associated end panel 18, 19, 22, 23, 26, and 27.

Figure 8:
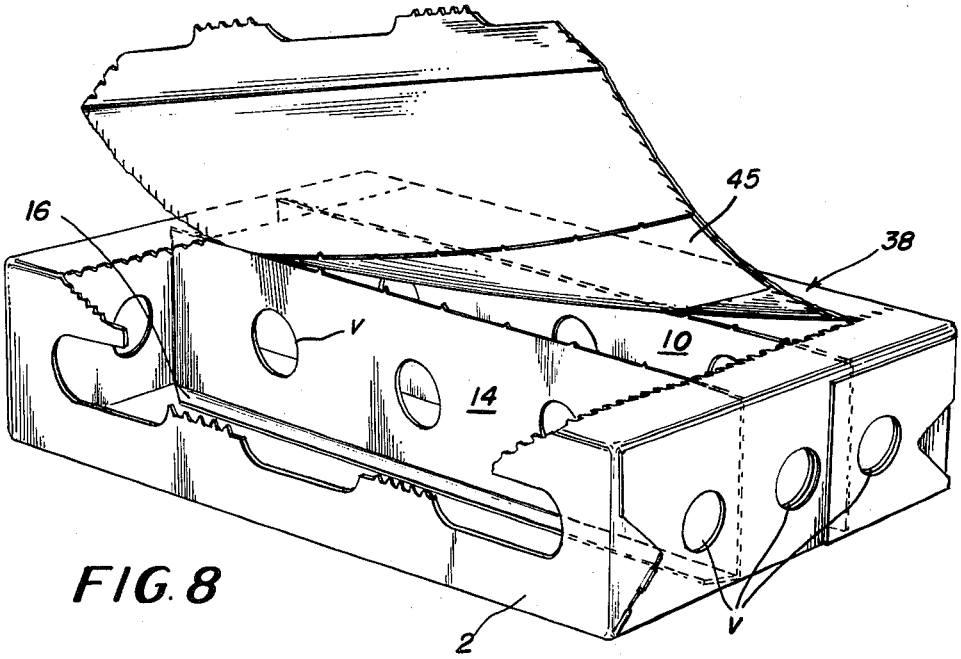
FIG. 8 is a perspective view showing the article case opening means for a modified form of the invention.
Figure 9:
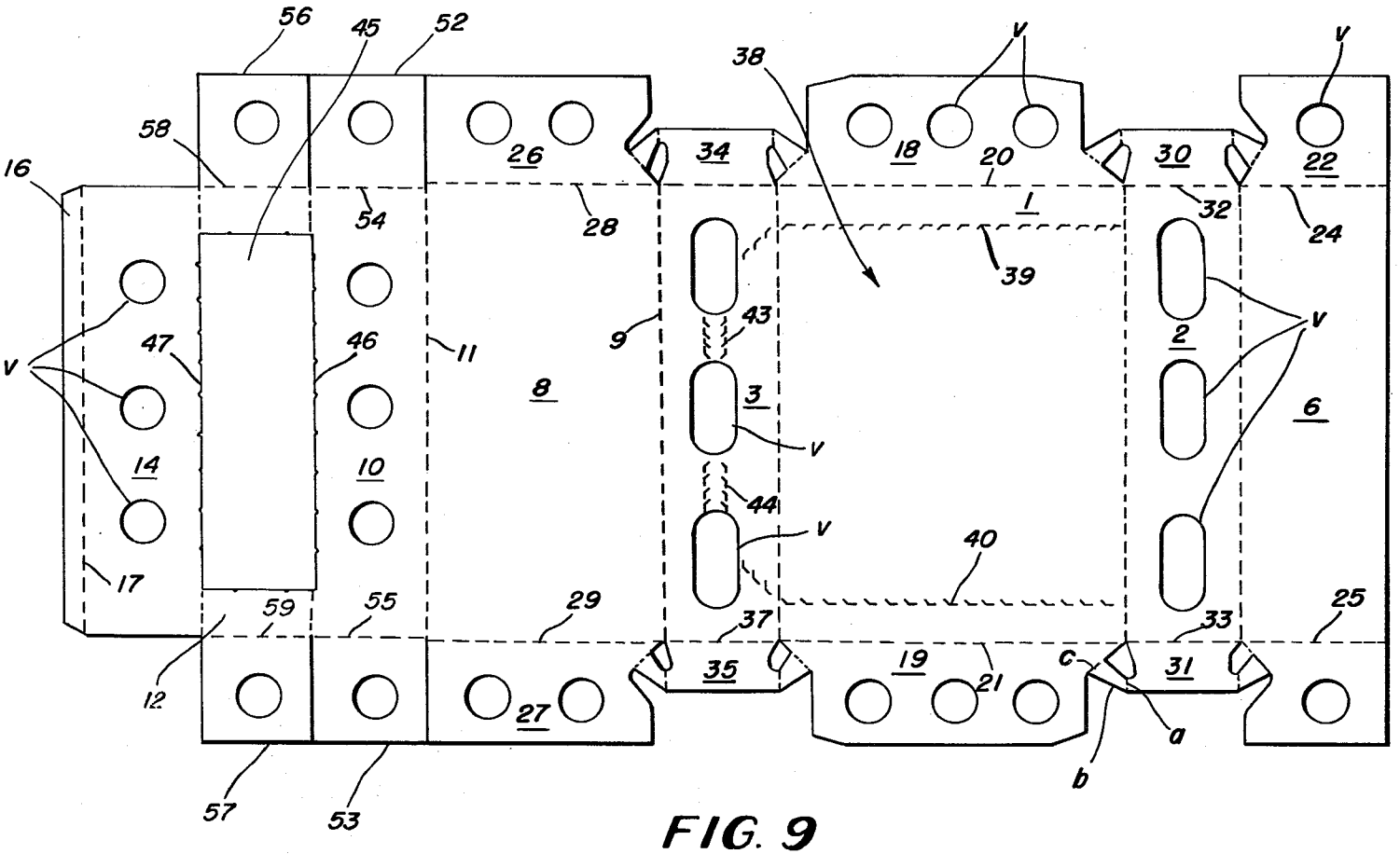
FIG. 9 is a plan view of the blank from which the case shown in FIG. 8 is formed.

The modified form of the invention shown in FIGS. 8 and 9 is quite similar to the article case just described and the same numerals are used to identify corresponding elements of the two cases. With particular reference to FIG. 9, reinforcing panels 52 and 53 are joined respectively to the opposite ends of rib panel 10 along fold lines 54 and 55. Similarly reinforcing panels 56 and 57 are joined respectively to the opposite ends of connecting panel 12 along fold lines 58 and 59. Also a series of ventilation apertures v are formed in the end panels, side walls, rib panels and reinforcing panels as is well known.

According to a feature of this invention, opening means for the article case is provided, in part, by means of a removable portion indicated generally by the numeral 38. More specifically removable portion 38 is defined by conventional tear lines 39, 40, 41, 42, 43, and 44 and each of the tear lines 41–44 is provided with a thumb tab t.

Also according to this invention a tear strip is formed in connecting panel 12 and is generally indicated by the numeral 45. Tear strip 45 is defined by opposing tear lines 46 and 47. Also flaps 48 and 49 are foldably joined respectively to the end edges of tear strip 45 along fold lines 50 and 51 in connection with the form of the invention shown in blank form in FIG. 3.

Figure 3:
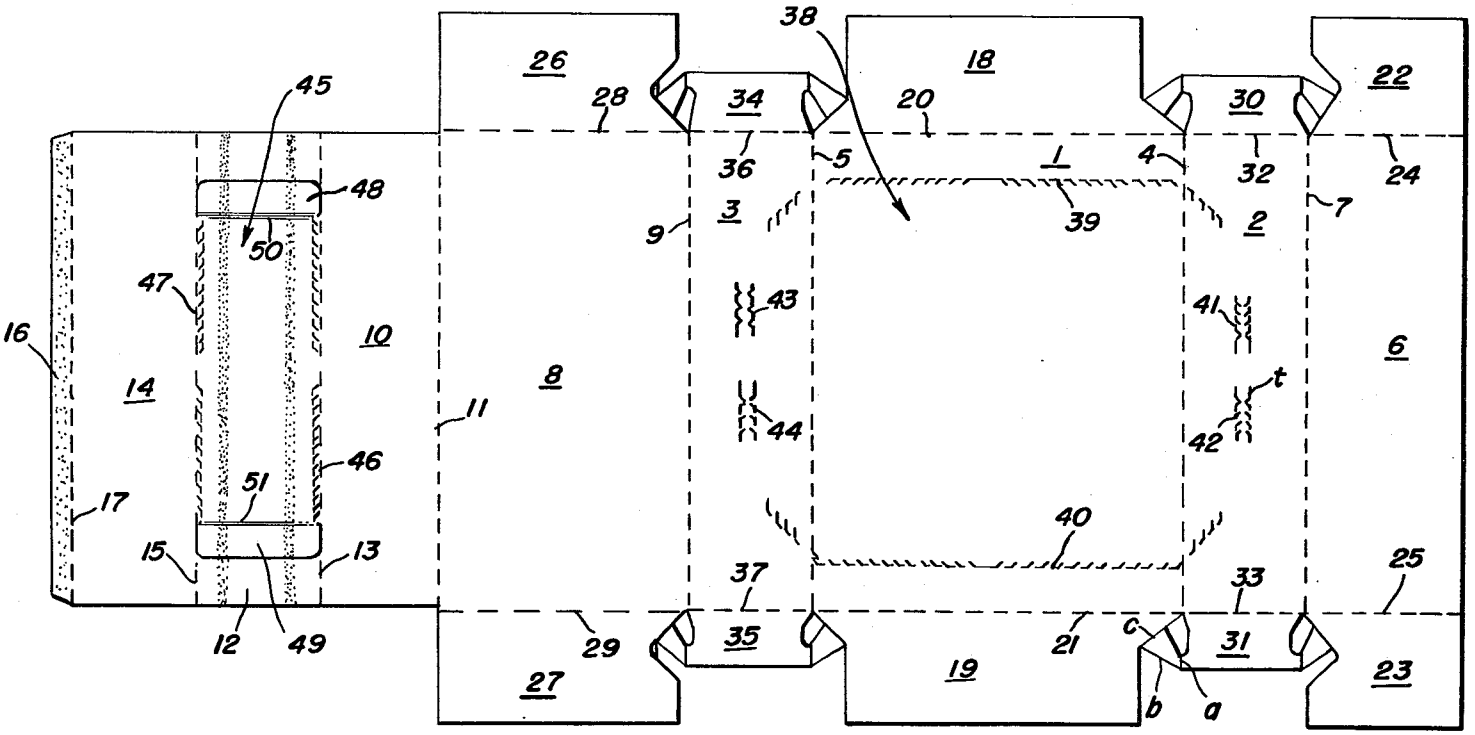
FIG. 3 is a plan view of a blank from which the article case shown in FIG. 1; is formed.
Figure 4:
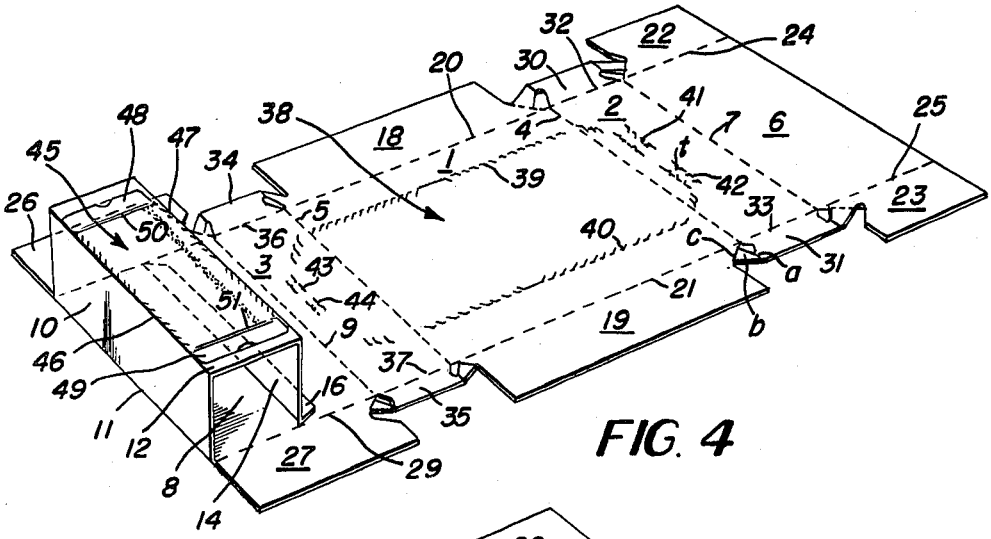
FIGS. 4, 5, 6, and 7 depict intermediate stages through which the blank shown in FIG. 3 is manipulated and glued in order to form the completed case as shown in FIG. 1.

In order to form the article case from the blank shown in FIGS. 3 and 9, initially it is necessary to make an application of glue to glue flap 16 as shown by stippling in FIG. 3 and then elevate and fold rib panels 10 and 14 and connecting panel 12 upwardly and over along fold line 11. The case then appears as shown in FIG. 4 and glue flap 16 is adhered to overlapping bottom panel 8. Then glue is applied to tear strip 45 as shown by stippling in FIG. 4. Following this rib panels 10 and 14, connecting panel 12, overlapping bottom panel 8, side wall 3 and the associated structure are all elevated and folded over along fold line 5 to occupy the positions shown in FIG. 5 and wherein tear strip 45 is adhered to removable portion 38.

Figure 5:
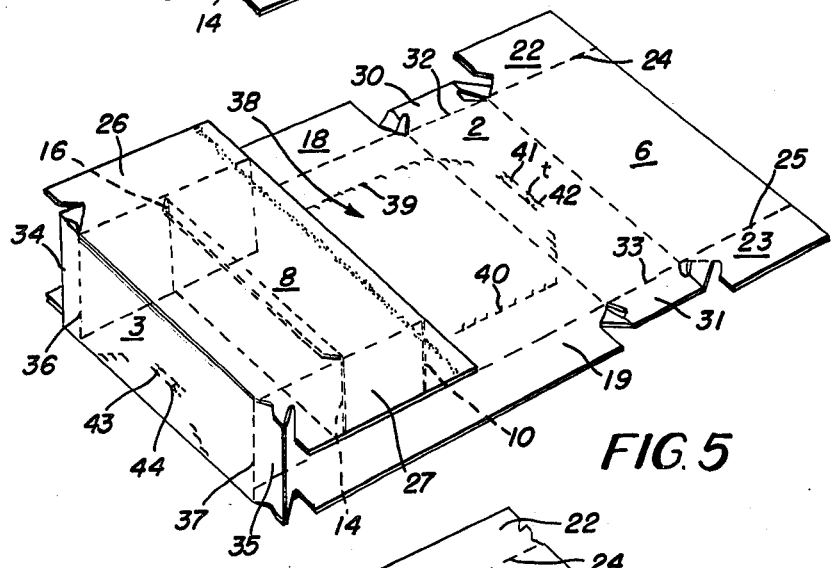
Figure 6:
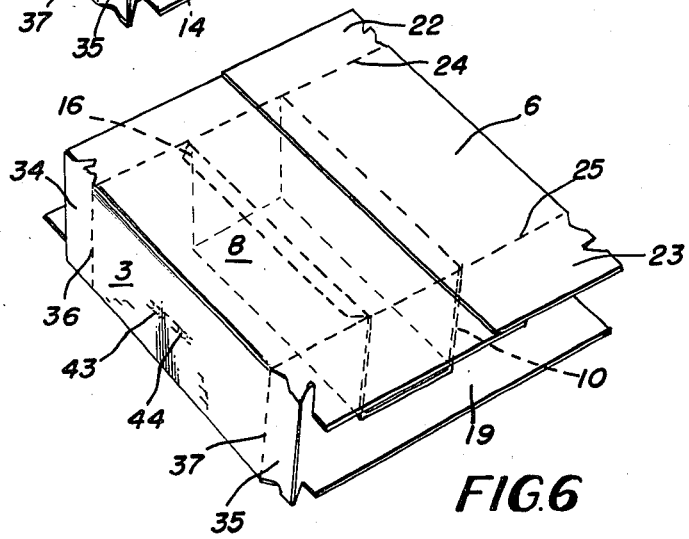

Then an application of glue is made to overlapping bottom panel 8 and end panels 26 and 27 as shown by stippling in FIG. 5. Following this overlapping bottom panel 6, side wall 2 and the associated structure are elevated and folded over along fold line 4 to occupy the positions shown in FIG. 6. In this manner overlapping bottom panels 6 and 8, end panels 22 and 26 and end panels 23 and 27 are adhered together respectively to form a composite bottom wall and composite end panels for the article case.

Then it is simply necessary to fold end flaps 30, 31, 34, and 35 inwardly to positions whereby each web panel b is disposed in flap contacting relation with the inner surface of the associated end panel 18, 19, 22, 23, 26, and 27.

Figure 7:
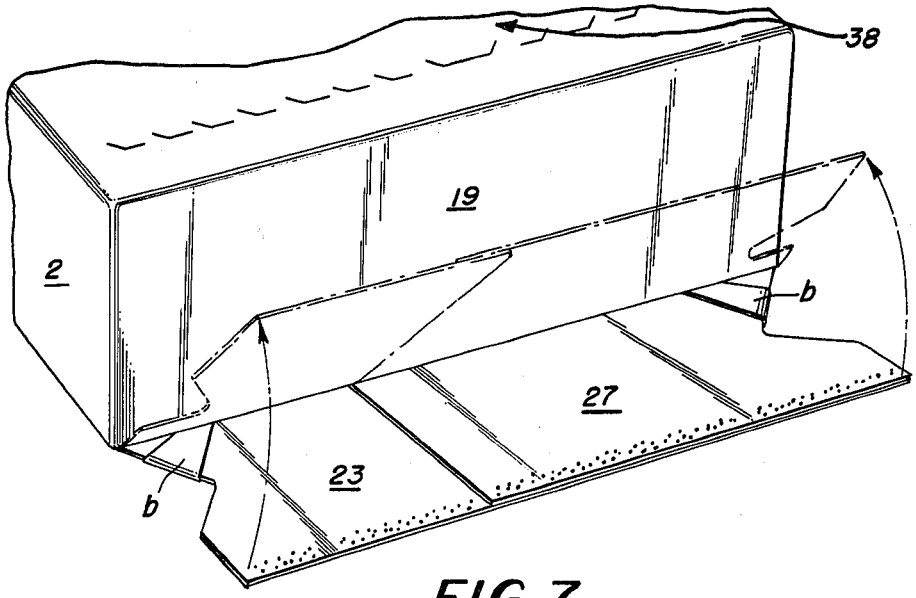

To complete formation of the article case, the end panels which are joined to the end edges of top wall 1 are folded downwardly. Following this glue is applied to the end panels joined to the end edges of composite bottom wall 6, 8 as shown by stippling in FIG. 7 and these elements are folded upwardly and adhered to the associated end panels joined to top wall 1. The article case then appears as shown in FIG. 1.

Figure 2:
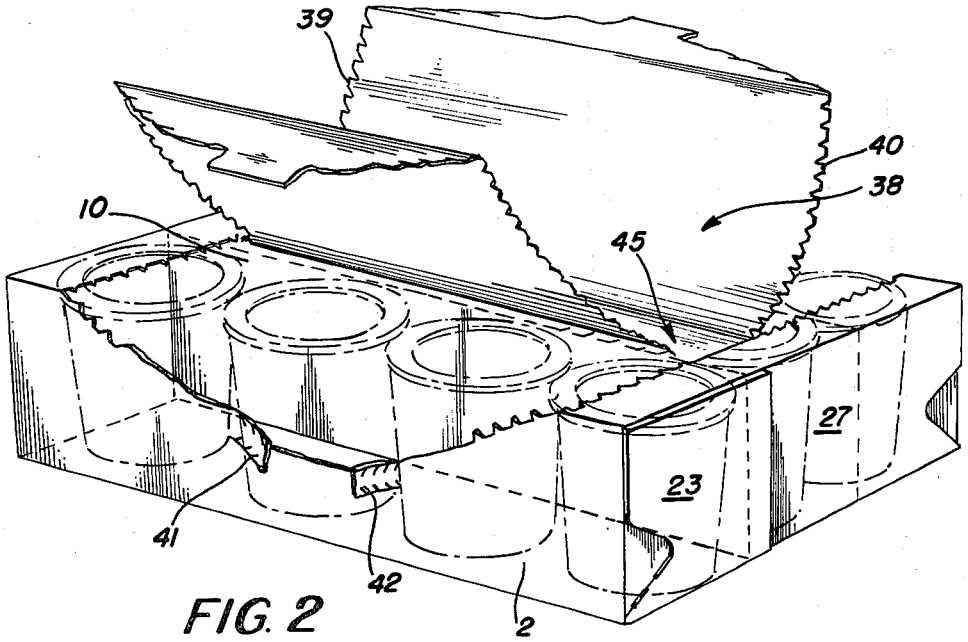
FIG. 2 is a view similar to FIG. 1 with the case partially opened and articles contained therein.

In order to gain access to the articles, initially it is necessary to grasp thumb tabs t and then simply to tear along tear lines 41–44. As shown in the version of the invention shown in FIG. 2 the ends of removable portion 38 are elevated, and simultaneously with this operation, separation occurs along tear lines 39 and 40 as well as tear lines 46 and 47 of tear strip 45. In this manner, access is available to the three rows of articles of the article case.

In the modified form of the invention shown in FIG. 8, only one side of removable portion 38 is elevated initially and, as it is completely removed in a single motion, tear strip 45 is automatically and simultaneously severed along tear lines 46 and 47. Also in the modified form of the invention reinforcing panels 52, 53, 56 and 57 are folded inwardly to positions perpendicular to the major axis of the case and provide additional support for the case.

Since the ends of top wall 1 remain intact, the article case is maintained in a sturdy condition which allows for reliable further handling of the case. Also since the articles are all exposed, prices can be conveniently placed thereon and of course the articles can be removed as desired. In summary since tapered articles are quite prone to toppling over without proper separation by rib means such as rib panels 10 and 14, this invention provides proper article stability and, at the same time, allows for convenient and easy access to all the articles especially those contained in the interior row of the article case.

INDUSTRIAL APPLICABILITY

By this invention an article case is provided which is extremely strudy during all stages of handling and has proper separation between the articles and also provides convenient access especially to those articles disposed between a pair of interior rib panels.

I claim:

1. An article case comprising a top wall, a pair of side walls foldably joined respectively to the side edges of said top wall and extending downwardly therefrom, a pair of overlapping bottom panels joined respectively to the lower edges of said side walls to form a bottom wall, a pair of end panels foldably joined respectively to the end edges of said top wall and extending downwardly therefrom, a pair of end panels foldably joined respectively to the end edges of said bottom wall and extending upwardly therefrom, a pair of spaced rib panels extending between said top and bottom walls, a connecting panel foldably joined respectively to the upper edges of said rib panels and being disposed in flat face contacting relation with the lower surface of said top wall, a tear strip formed in said connecting panel, a removable portion formed in said top wall, and said tear strip being attached to said removable portion to allow simultaneous removal of said tear strip as said removable portion is separated from said case.

2. An article case according to claim 1 wherein said removable portion extends into said side walls.

3. An article case according to claim 1 wherein one of said ribs is foldably joined to the edge of one of said overlapping bottom panels remote from the associated side wall.

4. An article case according to claim 3 wherein a glue flap is joined to the other of said ribs and is adhered to the upper surface of said bottom wall.

5. An article case according to claim 1 wherein one of said end panels at each end of said case is adhered in overlapping relation to the associated one of the other of said end panels.

6. An article case according to claim 1 wherein end flaps are foldably joined respectively to the end edges of said side walls.

7. An article case according to claim 6 wherein the ends of said end flaps are attached respectively to the associated ends of said end panels by means of web panels.

8. An article case according to claim 1 wherein a flap is foldably joined to an end edge of said tear strip.

9. An article case blank comprising a top wall, a pair of side walls joined respectively to the side edges of said top wall, a pair of bottom panels joined respectively to said side walls remote from said top wall, a first rib panel joined to the side edge of one of said bottom panels remote from said side wall, a connecting panel joined to said first rib panel remote from said one bottom panel, a second rib panel joined to said connecting panel remote from said first rib panel, a removable portion formed in said top wall, and a tear strip formed in said connecting panel.

10. An article case blank according to claim 9 wherein said removable portion extends into said side walls.

11. An article case blank according to claim 9 wherein end panels are joined respectively to the end edges of said top wall and said bottom panels.

12. An article case blank according to claim 9 wherein reinforcing panels are joined respectively to an end edge of said first rib panel and said connecting panel.

* * * * *